US005501130A

United States Patent [19]

Gannon et al.

[11] Patent Number: 5,501,130

[45] Date of Patent: Mar. 26, 1996

[54] JUST INTONATION TUNING

[75] Inventors: J. William Gannon, Vancouver; Rex A. Weyler, Manson's Landing, both of Canada

[73] Assignee: Musig Tuning Corporation, Vancouver, Canada

[21] Appl. No.: 194,245

[22] Filed: Feb. 10, 1994

[51] Int. Cl.[6] ..... G10G 7/02

[52] U.S. Cl. ..... 84/454; 84/601; 364/130

[58] Field of Search ..... 84/454, 601, 602; 364/130

[56] References Cited

U.S. PATENT DOCUMENTS

| | | | |
|---|---|---|---|
| 2,239,499 | 8/1942 | Fisher | 84/454 |
| 2,422,940 | 6/1947 | Waage | 84/454 |
| 2,525,524 | 10/1950 | Chase | 84/331 |
| 3,871,261 | 3/1975 | Wells et al. | 84/454 |
| 4,152,964 | 5/1979 | Waage | 84/454 |
| 4,248,119 | 2/1981 | Yamada | 84/454 |
| 4,419,916 | 12/1983 | Aoki | 84/454 |
| 4,434,696 | 3/1984 | Conviser | 84/454 |
| 4,498,363 | 2/1985 | Shimada et al. | 84/454 |
| 4,860,624 | 8/1989 | Dinnan et al. | 84/454 |

FOREIGN PATENT DOCUMENTS

| | | |
|---|---|---|
| 567319 | 9/1975 | Germany . |
| WO87/03993 | 7/1987 | WIPO . |
| WO90/07771 | 7/1990 | WIPO . |

*Primary Examiner*—Patrick J. Stanzione

*Attorney, Agent, or Firm*—Graybeal Jackson Haley & Johnson

[57] ABSTRACT

Apparatus for adjusting the tuning of a musical instrument to cause the instrument to sound in just intonation while the instrument is being played comprises a data base in memory for storing an array of just intonation tone identifiers. The tone identifiers in the array are arranged by key, chordal root and tone according to just intonation relationships defined by the ratios of a scale selected by the musician. A selector unit is provided for enabling a musician to select a key and/or a chordal root, as a result of which a CPU retrieves from the array a set of tone identifiers in just intonation corresponding to the selected key or chordal root and transmits them to the sounding means of the instrument.

14 Claims, 3 Drawing Sheets

JUST INTONATION TUNING

FIELD OF THE INVENTION

This invention relates to the tuning of musical instruments in just intonation. More particularly, the invention relates to a just intonation tuning system that can be applied to musical instruments in real time to cause instruments to be dynamically retuned in just intonation, while played in real time.

BACKGROUND OF THE INVENTION

It is generally known that the intervals of the equal tempered scale in popular use today are slightly out of tune in relation to pure harmony. Chords made from the intervals of this scale are disturbed by beats caused by this inexact tuning, resulting in dissonance. In contrast, tones derived from intervals of the just intonation scale form perfect harmonies, when sounded together. When a cappella choral singers sing or well trained chamber groups use unfretted instruments (violin, viola, cello), the pure harmonies of just intonation are heard. The equally tempered intervals were fixed in the seventeenth century to overcome mechanical difficulties in changing keys in fixed tone instruments like the piano, and fretted instruments like the guitar. In music dominated by the equally tempered intervals of the piano and guitar, pure harmonies are lost.

Just intonation intervals that create pure harmony can be defined by ratios of whole numbers such as 1:1, 2:1, 3:2, 4:3, and 5:4. Strings divided into these precise lengths give the same pure harmonies that singers had discovered naturally by ear. However, the tones created by these intervals are not entirely interchangeable when the key or chordal root of the music changes. That is, when the frequency of the tonic or key tone changes, a new musical scale is defined by the perfect ratios as applied to the new key tone. If the singers modulate the key from a key tone A(1:1) up to the key tone B(9:8 of key tone A) so as to define a new scale, some of the tones in the original scale will be found in the new scale, but not all; some tones of the new scale will be different. The D note played as a Fourth (4:3) of the key tone A is not the same frequency as the D note played as a Minor Third (6:5), of the key tone B. They are different because in the first case D is $4/3$ the frequency of A, whereas in the second case D is $6/5$ of $9/8$ the frequency of A. These two values are different by a small ratio: 81:80. Modern music makes them equal by splitting the difference between both notes. This is only one example of the errors of the equal tempered scale.

Staying in perfect tune while changing keys is not difficult for singers or for players of instruments that allow any tone to be played, for example a violin. But fixed-tone instruments like the organ, clavichord, harpsichord and piano had to be altered or tempered in order to play in more than one key.

In the seventeenth century, the scale of "equal temperament," was developed fixing 12 equal intervals into an octave, thereby allowing all fixed tones to be used in every key. In 1685 German organist and music theorist Andreas Werckmeister, and Prussian musician Johann Neidhardt calculated the equal intervals as the 12th roots of the powers of two ($2^1$, $2^2$, $2^3$, $2^4$, $2^5$, $2^6$, $2^7$, $2^8$, $2^9$, $2^{10}$, $2^{11}$, $2^{12}$,). This solved the problem of easy modulation for the pianos, but at the cost of throwing every interval out of pure tune.

Mechanical solutions to the problem of key modulation in just intonation were proposed by Hermann Helmholtz, Perronet Thompson, Henry Poole and others, but were simply too cumbersome and too limited to offer complete just intonation in all keys.

U.S. Pat. No. 3,821,460 to Motorola Inc. discloses an electronic keyboard capable of being tuned to equal temperament and just intonation, using programmable frequency dividers. The tuning, however, is not instantaneous, and the instrument can not be used for playing while allowing for modulation and chordal change in real time, but was rather meant as a static instructional tool. Furthermore, the keyboard does not realize true and complete just intonation scales.

U.S. Pat. No. 3,871,261 to Wells correctly pointed out that "the 'equal tempered' system has virtually gained universal acceptance . . . but does not eliminate the beats" caused by notes "not perfectly in tune." His invention proposes 12 frequency modifiers (12 potentiometers) for each key, to render the pitch of each note adjustable, and a key selection device to switch musical keys. Wells' scales are not truly just in all cases, and the combination tones and overtones create disturbing beats. Furthermore, there is no provision for changing chordal root within a given key.

Electronic keyboard manufacturers began introducing various microtuning features in 1985 using logarithmic cents as a micro tuning unit. Keyboards and tone generators were produced with preset alternative scales including so-called "Pure" scales in as many as 12 major and 12 minor diatonic scales. To access one of these scales, the user has to step through many menu choices, and therefore modulating to another key during a composition is out of the question. Also, no provision is made for chordal root changes.

U.S. Pat. No. 4,152,964 to Waage discloses an electronic system to approximate just intonation by retaining "the tempered fourths and fifths," and shifting "the pitch of certain notes to correct the larger tuning errors of the scale." This invention was only an approximation of just intonation.

U.S. Pat. No. 4,248,119 to Yamada is a pitch correction gate system that attempts to detect chord structure and then alter tones from equal temperament to just intonation as chords are being played. This approach is impractical because the mixture of equal temperament and just intonation is more dissonant than tempered tuning alone.

U.S. Pat. No. 4,434,696 to Conviser recognized that "the influences of fixed-pitch instruments have contributed to a loss of correct pitch and have caused vocalists and instrumentalists not constrained by fixed pitch to sing and play 'out of tune' either for equally tempered or 'just' performance. Basic to this problem has been the lack of technological development in instruments for either tempered tuning or just intonation." The Conviser invention uses compound ratios to create the frequencies of equal temperament and just intonation. Conviser uses the correct just-intonation intervals from Ptolemy: $9/8$, $5/4$, $4/3$, $3/2$, $5/3$, and $15/8$, but derives the other intervals by multiplying "by $16/15$ to obtain the flats . . . and by $25/24$ to obtain the sharps." The resulting scale is not a correct nor a complete just intonation scale. No truly just scale is given, and there is no provision for the necessary tonal changes when changing chordal root within a given key.

U.S. Pat. No. 4,498,363 to Shimada disclosed a "just intonation electronic keyboard instrument". The keyboard comprised "a plurality of tonality selection switches for selecting each key from among twenty-four just intonation keys . . . " It noted that keyboard instruments which are tuned according to equal temperament are unfit for use in teaching during chorus practice. The patent describes 12 major diatonic scales, and twelve minor diatonic scales, but not complete chromatic scales. The invention is intended for choral practice, and there is no provision for changing the tuning in real time nor is there any provision for chordal root changes.

U.S. Pat. No. 4,796,509 to Yamaha Corporation of Japan disclosed an electronic tuning apparatus based on both equal temperament and just intonation scales. This apparatus generates a scale based on a reference signal, and displays a tone name for each frequency of the scale. The tuner can accommodate a single just intonation scale, but does not provide for chordal root changes as a composition is being played.

The Yamaha YMF262 FM Operator Type L3 chip was developed as a sound source for computer musical keyboards and tone generators. It is also used on many commercially available audio cards. This chip contains a frequency modulation sound source which may be controlled by software. All functions of the synthesizer are controlled by data written to its register array. The function for sending the frequency requires that the frequency be multiplied by 1.31072, rounded off to the next whole number, and then sent to a 10 bit address on the chip. This rounding-off makes it impossible to attain the simple fractions required for perfect just intonation harmonies.

U.S. Pat. No. 4,860,624 to Dinnan attempted to solve overtone collision, or dissonance. However, only some of the ratios given by Dinnan are correct just intonation intervals. Others have no relationship to historically used just scale intervals, and they create most unusual harmonies that cannot be considered Just or Pure. The Dinnan invention makes no provision for altering the scale when changing chordal root within a given key.

In view of the foregoing review of the prior art, and the failure of previous proposals to solve the problem of pure intonation for fixed-tone musical instruments, one of the objects of the present invention is to create a just intonation system that overcomes the aforementioned disadvantages and answers all the requirements of pure intonation including ease of play and modulation of both key and chordal root while playing.

The failure of the previously proposed solutions is that they are only half-measures at best, and do not offer a comprehensive just intonation system. To be practical for musicians a just intonation system must be comprehensive and perfect for all chordal roots, all keys, all inversions of chords, and in relation to all overtones and combination tones. It must also allow dynamic play in real time with instantaneous switching of key and root while playing the notes.

SUMMARY OF THE INVENTION

The present invention is an electronic just intonation tuning apparatus and method that can be applied to musical instruments to create just intonation so that the instruments can be played in real time, based on any pitch, in all musical scales, using all musical scale intervals, in all chordal roots, in all musical keys.

The invention is based in part on the discovery that within the same key, when a chord changes, a new tuning of the musical scale is defined, based on the frequency of the new chordal root, and the new tuning variables are finite and can be identified by the selection of a key tonic and a chordal root. A key is defined by a tonic, or keynote, which is the fundamental note of a scale. The remaining notes of that scale are derived by the application of appropriate ratios to the tonic. The chordal root is the fundamental note of a chord within a given key. The present invention uses 3-dimensional (key, chordal root, and note) just intonation arrays based on accurate just intonation intervals for all chordal roots in all keys. The arrays may be implemented with an electronic logic circuit or by other logic means, including a programmed computer, mechanical linkage, hydraulics, pneumatics, or optics.

Each array defines $n^3$ tone identifiers, (per octave), where n=number of intervals (notes) of the scale (per octave). These are grouped in sets of n tone identifiers for each of n roots for each of n musical keys. The key tones of each of the n musical keys are related by a set of n ratios of whole numbers. The chordal roots of each key are also defined by a set (preferably the same set) of n ratios applied to each of the key tones. The tone identifiers in turn are defined by a set (preferably the same set) of n ratios applied to each of the chordal roots. In most, if not all, implementations of the invention, including the preferred embodiment, many of the tone identifiers will have the same value, greatly reducing the total number of individual pitches that must be generated. And, for particular embodiments, the number of tone identifiers can be further reduced by eliminating the possibility of selecting certain keys or certain chordal roots within the keys. Consequently, although the theoretical number of pitches identified by tone identifiers is $n^3$ actual embodiments may have a much smaller number.

The tone identifiers correspond to the pitches or intervals above a reference which are representative of an individual musical tone to be sounded when a note is selected by a musician. The tone identifiers can be direct representations of frequency, such as 660 Hertz, an indirect reference to a specific musical interval or tone, such as MU68, an electronic circuit, such as a tone generator circuit which is directly activated when the musician selects the key, the chordal root, and a note, or any other means for generating the appropriate pitch.

In general, the invention provides a key and root selector as well as a logic unit containing the array so as to maintain just intonation in all roots in all keys while playing.

Means are provided for the selection of a key and a root within that particular key before a musical composition is played or while it is being played, and means are provided to communicate the selections to the logic unit. If the instrument is a type that can receive a set of tone identifiers to specify each pitch that should be sounded when each note is selected by the musician, the set of tone identifiers corresponding to the selected key and root are transmitted to the musical instrument to be played. If not, the logic unit also receives note selections from the musician and, based on the selected key, the selected root, and the selected notes, causes the generation of appropriate pitches.

In one of its aspects, the invention is a method for adjusting the tuning of a musical instrument including a means for receiving a selected key and chordal root and a means for determining the just intonation tone to be sounded upon receipt of a selected note.

In another aspect, the invention comprises an electrical circuit having one or more inputs for receiving the selected key and the selected chordal root within the key and having an output which specifies the just intonation tones to be sounded. Either an entire set of tone identifiers is communicated to a note selection receiving means which causes the appropriate tone to be sounded when a note is selected by the musician, or the electrical circuit also has an input for receiving selected notes and the circuit in turn causes appropriate tones to be sounded.

In another aspect, the invention is computer software which causes a computer to perform the method described above or to become an embodiment of the apparatus described above.

In another aspect, the invention is a playable musical recording made by the method described above.

In another aspect, the invention is a method for generating musical recordings or output from musical data sequence recordings which were originally created with unspecified tuning or equal tempered tuning (or any tuning) by adding to the musical data sequence recording selections of key and chordal root, allowing the recording to be played in just intonation.

When a musician determines in advance the composition to be performed, the musician may make a recording of the key selections and the chordal roots selections desired by the musician. Then the musician plays the composition while the recording of key and chordal root selections is being played, eliminating the need for the musician to change the chordal root specification during the performance. Consequently, in another aspect, the invention is a recording of a sequence of selected keys and chordal roots for performing the method described above.

In another of its aspects, the invention comprises apparatus for adjusting the tuning of a musical instrument to play in just intonation while the instrument is being played, comprising sounding means associated with the musical instrument for producing musical tones, a logic unit for storing $n^3$ tone identifiers, where n=number of tones in one octave of a scale, the tone identifiers being grouped in sets of n tone identifiers for each of n chordal roots for each of n musical keys, and wherein each tone identifier corresponds to a tone to be generated by the sounding means of the instrument and wherein the set of tones corresponding to the tone identifiers produce just intonation intervals, selection means associated with the musical instrument for enabling a musician to select a key and chordal root within a key in which tones of a composition are to be played, a logic means associated with the musical instrument, means for communicating the key and chordal root selected by the selection means to the logic means, retrieving at least one tone identifier from the set of n tone identifiers corresponding to the key and the chordal root selected by said selection means and communicating to the sounding means said at least one tone identifier.

In another of its aspects, the invention comprises a method of adjusting the tuning of a musical instrument to play in just intonation while the instrument is being played wherein selection means are associated with the musical instrument for enabling a musician to select a key and a chordal root, and memory means are associated with the musical instrument for storing sets of n tone identifiers for each of n chordal roots for each of n musical keys; and sounding means are associated with the musical instrument for producing musical tones, comprising selecting a key and a chordal root within a musical key, communicating said selected key and chordal root to the said memory, retrieving from said memory at least one tone identifier selected from the set of n tone identifiers corresponding to the selected key and chordal root, communicating said at least one tone identifier to said sounding means of said musical instrument whereby to cause the sounding means to produce said at least one tone when the note which calls for that tone is selected to be played by the musician.

The invention may be more fully appreciated by reference to the following description of the preferred and alternative embodiments of the invention and by reference to the drawings thereof and associated tables.

DETAILED DESCRIPTION OF THE PREFERRED EMBODIMENT

Figure 1:
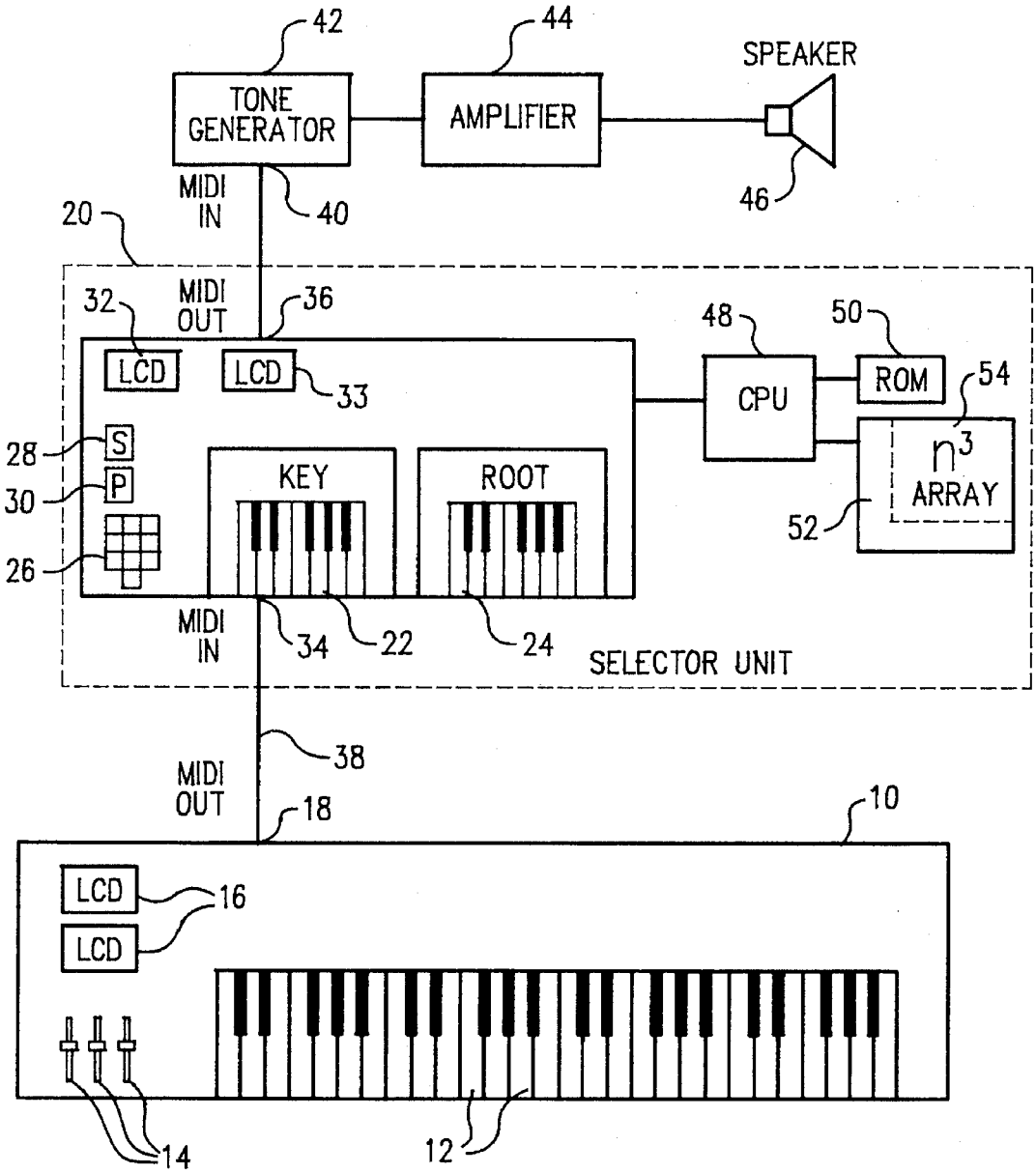
FIG. 1 illustrates the preferred embodiment of the invention in association with an electronic keyboard.

The preferred embodiment of the invention is illustrated in FIG. 1. A standard digital electronic keyboard 10 is provided having instrument keys 12, hand wheels 14 and LCD displays 16. The keyboard 10 also includes a MIDI OUT port 18.

A separate key and root selector unit 20 is provided. The selector unit 20 includes 12 key selectors 22, 12 root selectors 24, a numerical keypad 26, a scale selection button 28, a pitch selection button 30, and two LCD displays 32, 33. The selector unit has a MIDI IN port 34 and a MIDI OUT port 36. The MIDI IN port 34 of the selector unit 20 is connected to MIDI OUT port 18 of the keyboard by means of MIDI compatible cabling 38.

The MIDI IN port 40 of a tone generator 42 is connected to the MIDI OUT port 36 of the selector unit 20. The tone generator 42 must be one that is capable of being tuned. The tone generator 42 is connected to an amplifier 44 which is in turn connected to a speaker 46.

A CPU 48, a ROM chip 50 and a RAM chip 52 are provided on a circuit board (not shown) within the housing of the selector unit 20.

The CPU 48 is provided with software to implement the invention. FIG. 5 is a flowchart of the software of the preferred embodiment, although other approaches might be used within the parameters of the invention.

The RAM chip 52 is used to store an array 54 of tone identifiers which are used to adjust the tuning of the tone generator 42 as described below.

A just intonation musical scale is defined according to a set of ratios of whole numbers which by convention and by empirical confirmation by the inventors define just intonation scales. The preferred embodiment of the invention uses the sets of ratios identified in Table I.

TABLE I (Sets of Ratios Defining Scales in Just Intonation)

(a) 1:1, 16:15, 9:8, 6:5, 5:4, 4:3, 7:5, 3:2, 8:5, 5:3, 7:4, 15:8, (plus Octaves)

(b) 1:1, 16:15, 9:8, 6:5, 5:4, 4:3, 7:5, 3:2, 8:5, 5:3, 9:5, 15:8, (plus Octaves);

(c) 1:1, 16:15, 9:8, 6:5, 5:4, 4:3, 7:5, 3:2, 8:5, 5:3, 16:9, 15:8, (plus Octaves);

(d) 1:1, 16:15, 9:8, 7:6, 5:4, 4:3, 7:5, 3:2, 8:5, 5:3, 7:4, 9:5, 11:6, 15:8, (plus Octaves);

(e) 1:1, 16:15, 9:8, 8:7, 7:6, 6:5, 5:4, 4:3, 7:5, 3:2, 8:5, 5:3, 7:4, 16:9, 9:5, 11:6, 15:8, (plus Octaves);

(f) 1:1, 16:15, 9:8, 6:5, 5:4, 4:3, 45:32, 3:2, 8:5, 5:3, 9:5, 15:8, (plus Octaves);

(g) 1:1, 16:15, 9:8, 6:5, 5:4, 4:3, 45:32, 3:2, 8:5, 5:3, 16:9, 15:8, (plus Octaves);

(h) 1:1, 9:8, 5:4, 3:2, 5:3, (plus Octaves);

(i) 1:1, 16:15, 9:8, 6:5, 5:4, 4:3, 45:32, 64:45, 3:2, 8:5, 5:3, 9:5, 15:8 (plus Octaves);

(j) 1:1, 16:15, 9:8, 6:5, 5:4, 4:3, 45:32, 64:45, 3:2, 8:5, 5:3, 16:9, 15:8 (plus Octaves).

The sets of ratios, such as those in Table I, are stored in the ROM chip 50.

A just intonation scale may be defined for any reference pitch. The preferred embodiment of the invention uses a default pitch of A=440 Hz. The invention allows for any calibration of pitch, for example as where a musician wishes to sing a melody in a key that is half way between standard A and B flat, at perhaps 455 Hz or 460 Hz, due to the peculiarities of the song or the limitations of voice range. The reference pitch is chosen by a musician by using the numerical keypad and the pitch selection button of the selector unit. Any reference pitch may be chosen so long as it is within the range of the tone generator.

The musician also selects the just intonation scale which is to be used from the scales in Table I, using the numerical keypad 26 and the scale selection button 28. The default selection of the preferred embodiment is scale (c) of Table I representing a chromatic scale.

According to the invention, the just intonation array 54 is based on the number of ratios in the set of ratios defining the just intonation scale. In the case of scale (c) of Table I, n=12. The array will contain $n^3$ (1728) addresses. When the musician selects a scale using the keypad, the CPU reserves a block of RAM sufficient to contain an array of $n^3$addresses. Each address will contain a tone identifier.

The array is constructed by applying the set of n ratios to the reference pitch to define n key tones. The key tones represent the tonic for each musical key. The set of n ratios is applied to each of the n key tones to define n chordal root tones for each key tone. This results in $n^2$ chordal root tones. Chordal root tones will be referred to in this specification and in the claims as "chordal roots". They represent the tonic of any given chord. The set of n ratios is again applied to the n chordal roots to define n tone identifiers for each of the $n^2$ chordal roots. The result is $n^3$tones. The tones are generally symbolic or numerical representations of tones and are therefore referred to as tone identifiers in this specification and in the claims, The calculation of the array is accomplished by the CPU 48 which first retrieves from ROM 50 the set of ratios defining the selected scale and performing the necessary calculations based on the selected reference pitch. The resulting array of $n^3$tone identifiers is stored in the block of RAM 52 which was reserved by the CPU 48.

The tone identifiers of the array are arranged in groups of musical keys, chordal roots and individual tone identifiers. The tone identifiers may be any direct or indirect representation of tones, including individual tone generation circuits or other devices. In the preferred embodiment, this representation is a binary representation of frequency in Hertz, to an accuracy of at least four decimal places. The musical keys, chordal roots and tones represented by the tone identifiers are each in just intonation with respect to one another to define a flexible just intonation musical scale.

Table II illustrates the array based on a reference pitch of 440 Hz and the scale (c) of Table I.

TABLE II

Array of tone identifiers for one octave based on reference pitch of 440 Hertz and scale (c) of Table I K = Key R = Chordal Root I = Tone Identifier

| K1 R1 | K1 R2 | K1 R3 | I | K1 R4 | K1 R5 | K1 R6 |
|---|---|---|---|---|---|---|
| 440.0000 | 469.3333 | 495.0000 | 1 | 528.0000 | 550.0000 | 586.6667 |
| 469.3333 | 500.6222 | 528.0000 | 2 | 563.2000 | 586.6667 | 625.7778 |
| 495.0000 | 528.0000 | 556.8750 | 3 | 594.0000 | 618.7500 | 660.0000 |
| 528.0000 | 563.2000 | 594.0000 | 4 | 633.6000 | 660.0000 | 704.0000 |
| 550.0000 | 586.6667 | 618.7500 | 5 | 660.0000 | 687.5000 | 733.3333 |
| 586.6667 | 625.7778 | 660.0000 | 6 | 704.0000 | 733.3333 | 782.2222 |
| 616.0000 | 657.0667 | 693.0000 | 7 | 739.2000 | 770.0000 | 821.3333 |
| 660.0000 | 704.0000 | 742.5000 | 8 | 792.0000 | 825.0000 | 440.0000 |
| 704.0000 | 750.9333 | 792.0000 | 9 | 844.8000 | 440.0000 | 469.3333 |
| 733.3333 | 782.2222 | 825.0000 | 10 | 440.0000 | 458.3333 | 488.8889 |
| 782.2222 | 834.3704 | 440.0000 | 11 | 469.3333 | 488.8889 | 521.4815 |
| 825.0000 | 440.0000 | 464.0625 | 12 | 495.0000 | 515.6250 | 550.0000 |
| **K1 R7** | **K1 R8** | **K1 R9** | **I** | **K1 R10** | **K1 R11** | **K1 R12** |
| 616.0000 | 660.0000 | 704.0000 | 1 | 733.3333 | 782.2222 | 825.0000 |
| 657.0667 | 704.0000 | 750.9333 | 2 | 782.2222 | 834.3704 | 440.0000 |
| 693.0000 | 742.5000 | 792.0000 | 3 | 825.0000 | 440.0000 | 464.0625 |
| 739.2000 | 792.0000 | 844.8000 | 4 | 440.0000 | 469.3333 | 495.0000 |
| 770.0000 | 825.0000 | 440.0000 | 5 | 458.3333 | 488.8889 | 515.6250 |
| 821.3333 | 440.0000 | 469.3333 | 6 | 488.8889 | 521.4815 | 550.0000 |
| 862.4000 | 462.0000 | 492.8000 | 7 | 513.3333 | 547.5556 | 577.5000 |
| 462.0000 | 495.0000 | 528.0000 | 8 | 550.0000 | 586.6667 | 618.7500 |
| 492.8000 | 528.0000 | 563.2000 | 9 | 586.6667 | 625.7778 | 660.0000 |
| 513.3333 | 550.0000 | 586.6667 | 10 | 611.1111 | 651.8519 | 687.5000 |
| 547.5556 | 586.6667 | 625.7778 | 11 | 651.8519 | 695.3086 | 733.3333 |
| 577.5000 | 618.7500 | 660.0000 | 12 | 687.5000 | 733.3333 | 773.4375 |
| **K2 R1** | **K2 R2** | **K2 R3** | **I** | **K2 R4** | **K2 R5** | **K2 R6** |
| 469.3333 | 500.6222 | 528.0000 | 1 | 563.2000 | 586.6667 | 625.7778 |

TABLE II-continued

Array of tone identifiers for one octave based on reference pitch of 440 Hertz and scale (c) of Table I K = Key R = Chordal Root I = Tone Identifier

| | | | | | | |
|---|---|---|---|---|---|---|
| 500.6222 | 533.9970 | 563.2000 | 2 | 600.7467 | 625.7778 | 667.4963 |
| 528.0000 | 563.2000 | 594.0000 | 3 | 633.6000 | 660.0000 | 704.0000 |
| 563.2000 | 600.7467 | 633.6000 | 4 | 675.8400 | 704.0000 | 750.9333 |
| 586.6667 | 625.7778 | 660.0000 | 5 | 704.0000 | 733.3333 | 782.2222 |
| 625.7778 | 667.4963 | 704.0000 | 6 | 750.9333 | 782.2222 | 834.3704 |
| 657.0667 | 700.8711 | 739.2000 | 7 | 788.4800 | 821.3333 | 876.0889 |
| 704.0000 | 750.9333 | 792.0000 | 8 | 844.8000 | 440.0000 | 469.3333 |
| 750.9333 | 800.9956 | 844.8000 | 9 | 450.5600 | 469.3333 | 500.6222 |
| 782.2222 | 834.3704 | 440.0000 | 10 | 469.3333 | 488.8889 | 521.4815 |
| 834.3704 | 444.9975 | 469.3333 | 11 | 500.6222 | 521.4815 | 556.2469 |
| 440.0000 | 469.3333 | 495.0000 | 12 | 528.0000 | 550.0000 | 586.6667 |
| K2 R7 | K2 R8 | K2 R9 | I | K2 R10 | K2 R11 | K2 R12 |
| 657.0667 | 704.0000 | 750.9333 | 1 | 782.2222 | 834.3704 | 440.0000 |
| 700.8711 | 750.9333 | 800.9956 | 2 | 834.3704 | 444.9975 | 469.3333 |
| 739.2000 | 792.0000 | 844.8000 | 3 | 440.0000 | 469.3333 | 495.0000 |
| 788.4800 | 844.8000 | 450.5600 | 4 | 469.3333 | 500.6222 | 528.0000 |
| 821.3333 | 440.0000 | 469.3333 | 5 | 488.8889 | 521.4815 | 550.0000 |
| 876.0889 | 469.3333 | 500.6222 | 6 | 521.4815 | 556.2469 | 586.6667 |
| 459.9467 | 492.8000 | 525.6533 | 7 | 547.5556 | 584.0593 | 616.0000 |
| 492.8000 | 528.0000 | 563.2000 | 8 | 586.6667 | 625.7778 | 660.0000 |
| 525.6533 | 563.2000 | 600.7467 | 9 | 625.7778 | 667.4963 | 704.0000 |
| 547.5556 | 586.6667 | 625.7778 | 10 | 651.8519 | 695.3086 | 733.3333 |
| 584.0593 | 625.7778 | 667.4963 | 11 | 695.3086 | 741.6626 | 782.2222 |
| 616.0000 | 660.0000 | 704.0000 | 12 | 733.3333 | 782.2222 | 825.0000 |
| K3 R1 | K3 R2 | K3 R3 | I | K3 R4 | K3 R5 | K3 R6 |
| 495.0000 | 528.0000 | 556.8750 | 1 | 594.0000 | 618.7500 | 660.0000 |
| 528.0000 | 563.2000 | 594.0000 | 2 | 633.6000 | 660.0000 | 704.0000 |
| 556.8750 | 594.0000 | 626.4844 | 3 | 668.2500 | 696.0938 | 742.5000 |
| 594.0000 | 633.6000 | 668.2500 | 4 | 712.8000 | 742.5000 | 792.0000 |
| 618.7500 | 660.0000 | 696.0938 | 5 | 742.5000 | 773.4375 | 825.0000 |
| 660.0000 | 704.0000 | 742.5000 | 6 | 792.0000 | 825.0000 | 880.0000 |
| 693.0000 | 739.2000 | 779.6250 | 7 | 831.6000 | 866.2500 | 462.0000 |
| 742.5000 | 792.0000 | 835.3125 | 8 | 445.5000 | 464.0625 | 495.0000 |
| 792.0000 | 844.8000 | 445.5000 | 9 | 475.2000 | 495.0000 | 528.0000 |
| 825.0000 | 440.0000 | 464.0625 | 10 | 495.0000 | 515.6250 | 550.0000 |
| 440.0000 | 469.3333 | 495.0000 | 11 | 528.0000 | 550.0000 | 586.6667 |
| 464.0625 | 495.0000 | 522.0703 | 12 | 556.8750 | 580.0781 | 618.7500 |
| K3 R7 | K3 R8 | K3 R9 | I | K3 R10 | K3 R11 | K3 R12 |
| 693.0000 | 742.5000 | 792.0000 | 1 | 825.0000 | 440.0000 | 464.0625 |
| 739.2000 | 792.0000 | 844.8000 | 2 | 440.0000 | 469.3333 | 495.0000 |
| 779.6250 | 835.3125 | 445.5000 | 3 | 464.0625 | 495.0000 | 522.0703 |
| 831.6000 | 445.5000 | 475.2000 | 4 | 495.0000 | 528.0000 | 556.8750 |
| 866.2500 | 464.0625 | 495.0000 | 5 | 515.6250 | 550.0000 | 580.0781 |
| 462.0000 | 495.0000 | 528.0000 | 6 | 550.0000 | 586.6667 | 618.7500 |
| 485.1000 | 519.7500 | 554.4000 | 7 | 577.5000 | 616.0000 | 649.6875 |
| 519.7500 | 556.8750 | 594.0000 | 8 | 618.7500 | 660.0000 | 696.0938 |
| 554.4000 | 594.0000 | 633.6000 | 9 | 660.0000 | 704.0000 | 742.5000 |
| 577.5000 | 618.7500 | 660.0000 | 10 | 687.5000 | 733.3333 | 773.4375 |
| 616.0000 | 660.0000 | 704.0000 | 11 | 733.3333 | 782.2222 | 825.0000 |
| 649.6875 | 696.0938 | 742.5000 | 12 | 773.4375 | 825.0000 | 870.1172 |
| K4 R1 | K4 R2 | K4 R3 | I | K4 R4 | K4 R5 | K4 R6 |
| 528.0000 | 563.2000 | 594.0000 | 1 | 633.6000 | 660.0000 | 704.0000 |
| 563.2000 | 600.7467 | 633.6000 | 2 | 675.8400 | 704.0000 | 750.9333 |
| 594.0000 | 633.6000 | 668.2500 | 3 | 712.8000 | 742.5000 | 792.0000 |
| 633.6000 | 675.8400 | 712.8000 | 4 | 760.3200 | 792.0000 | 844.8000 |
| 660.0000 | 704.0000 | 742.5000 | 5 | 792.0000 | 825.0000 | 440.0000 |
| 704.0000 | 750.9333 | 792.0000 | 6 | 844.8000 | 440.0000 | 469.3333 |
| 739.2000 | 788.4800 | 831.6000 | 7 | 443.5200 | 462.0000 | 492.8000 |
| 792.0000 | 844.8000 | 445.5000 | 8 | 475.2000 | 495.0000 | 528.0000 |
| 844.8000 | 450.5600 | 475.2000 | 9 | 506.8800 | 528.0000 | 563.2000 |
| 440.0000 | 469.3333 | 495.0000 | 10 | 528.0000 | 550.0000 | 586.6667 |
| 469.3333 | 500.6222 | 528.0000 | 11 | 563.2000 | 586.6667 | 625.7778 |
| 495.0000 | 528.0000 | 556.8750 | 12 | 594.0000 | 618.7500 | 660.0000 |
| K4 R7 | K4 R8 | K4 R9 | I | K4 R10 | K4 R11 | K4 R12 |

TABLE II-continued

Array of tone identifiers for one octave based on reference pitch of 440 Hertz and scale (c) of Table I K = Key R = Chordal Root I = Tone Identifier

| | | | | | | |
|---|---|---|---|---|---|---|
| 739.2000 | 792.0000 | 844.8000 | 1 | 440.0000 | 469.3333 | 495.0000 |
| 788.4800 | 844.8000 | 450.5600 | 2 | 469.3333 | 500.6222 | 528.0000 |
| 831.6000 | 445.5000 | 475.2000 | 3 | 495.0000 | 528.0000 | 556.8750 |
| 443.5200 | 475.2000 | 506.8800 | 4 | 528.0000 | 563.2000 | 594.0000 |
| 462.0000 | 495.0000 | 528.0000 | 5 | 550.0000 | 586.6667 | 618.7500 |
| 492.8000 | 528.0000 | 563.2000 | 6 | 586.6667 | 625.7778 | 660.0000 |
| 517.4400 | 554.4000 | 591.3600 | 7 | 616.0000 | 657.0667 | 693.0000 |
| 554.4000 | 594.0000 | 633.6000 | 8 | 660.0000 | 704.0000 | 742.5000 |
| 591.3600 | 633.6000 | 675.8400 | 9 | 704.0000 | 750.9333 | 792.0000 |
| 616.0000 | 660.0000 | 704.0000 | 10 | 733.3333 | 782.2222 | 825.0000 |
| 657.0667 | 704.0000 | 750.9333 | 11 | 782.2222 | 834.3704 | 440.0000 |
| 693.0000 | 742.5000 | 792.0000 | 12 | 825.0000 | 440.0000 | 464.0625 |
| K5 R1 | K5 R2 | K5 R3 | I | K5 R4 | K5 R5 | K5 R6 |
| 550.0000 | 586.6667 | 618.7500 | 1 | 660.0000 | 687.5000 | 733.3333 |
| 586.6667 | 625.7778 | 660.0000 | 2 | 704.0000 | 733.3333 | 782.2222 |
| 618.7500 | 660.0000 | 696.0938 | 3 | 742.5000 | 773.4375 | 825.0000 |
| 660.0000 | 704.0000 | 742.5000 | 4 | 792.0000 | 825.0000 | 880.0000 |
| 687.5000 | 733.3333 | 773.4375 | 5 | 825.0000 | 859.3750 | 458.3333 |
| 733.3333 | 782.2222 | 825.0000 | 6 | 880.0000 | 458.3333 | 488.8889 |
| 770.0000 | 821.3333 | 866.2500 | 7 | 462.0000 | 481.2500 | 513.3333 |
| 825.0000 | 440.0000 | 464.0625 | 8 | 495.0000 | 515.6250 | 550.0000 |
| 440.0000 | 469.3333 | 495.0000 | 9 | 528.0000 | 550.0000 | 586.6667 |
| 458.3333 | 488.8889 | 515.6250 | 10 | 550.0000 | 572.9167 | 611.1111 |
| 488.8889 | 521.4815 | 550.0000 | 11 | 586.6667 | 611.1111 | 651.8519 |
| 515.6250 | 550.0000 | 580.0781 | 12 | 618.7500 | 644.5313 | 687.5000 |
| K5 R7 | K5 R8 | K5 R9 | I | K5 R10 | K5 R11 | K5 R12 |
| 770.0000 | 825.0000 | 440.0000 | 1 | 458.3333 | 488.8889 | 515.6250 |
| 821.3333 | 440.0000 | 469.3333 | 2 | 488.8889 | 521.4815 | 550.0000 |
| 866.2500 | 464.0625 | 495.0000 | 3 | 515.6250 | 550.0000 | 580.0781 |
| 462.0000 | 495.0000 | 528.0000 | 4 | 550.0000 | 586.6667 | 618.7500 |
| 481.2500 | 515.6250 | 550.0000 | 5 | 572.9167 | 611.1111 | 644.5313 |
| 513.3333 | 550.0000 | 586.6667 | 6 | 611.1111 | 651.8519 | 687.5000 |
| 539.0000 | 577.5000 | 616.0000 | 7 | 641.6667 | 684.4444 | 721.8750 |
| 577.5000 | 618.7500 | 660.0000 | 8 | 687.5000 | 733.3333 | 773.4375 |
| 616.0000 | 660.0000 | 704.0000 | 9 | 733.3333 | 782.2222 | 825.0000 |
| 641.6667 | 687.5000 | 733.3333 | 10 | 763.8889 | 814.8148 | 859.3750 |
| 684.4444 | 733.3333 | 782.2222 | 11 | 814.8148 | 869.1358 | 458.3333 |
| 721.8750 | 773.4375 | 825.0000 | 12 | 859.3750 | 458.3333 | 483.3984 |
| K6 R1 | K6 R2 | K6 R3 | I | K6 R4 | K6 R5 | K6 R6 |
| 586.6667 | 625.7778 | 660.0000 | 1 | 704.0000 | 733.3333 | 782.2222 |
| 625.7778 | 667.4963 | 704.0000 | 2 | 750.9333 | 782.2222 | 834.3704 |
| 660.0000 | 704.0000 | 742.5000 | 3 | 792.0000 | 825.0000 | 880.0000 |
| 704.0000 | 750.9333 | 792.0000 | 4 | 844.8000 | 880.0000 | 469.3333 |
| 733.3333 | 782.2222 | 825.0000 | 5 | 860.0000 | 458.3333 | 488.8889 |
| 782.2222 | 834.3704 | 880.0000 | 6 | 469.3333 | 488.8889 | 521.4815 |
| 821.3333 | 876.0889 | 462.0000 | 7 | 492.8000 | 513.3333 | 547.5556 |
| 440.0000 | 469.3333 | 495.0000 | 8 | 528.0000 | 550.0000 | 586.6667 |
| 469.3333 | 500.6222 | 528.0000 | 9 | 563.2000 | 586.6667 | 625.7778 |
| 488.8889 | 521.4815 | 550.0000 | 10 | 586.6667 | 611.1111 | 651.8519 |
| 521.4815 | 556.2469 | 586.6667 | 11 | 625.7778 | 651.8519 | 695.3086 |
| 550.0000 | 586.6667 | 618.7500 | 12 | 660.0000 | 687.5000 | 733.3333 |
| K6 R7 | K6 R8 | K6 R9 | I | K6 R10 | K6 R11 | K6 R12 |
| 821.3333 | 440.0000 | 469.3333 | 1 | 488.8889 | 521.4815 | 550.0000 |
| 876.0889 | 469.3333 | 500.6222 | 2 | 521.4815 | 556.2469 | 586.6667 |
| 462.0000 | 495.0000 | 528.0000 | 3 | 550.0000 | 586.6667 | 618.7500 |
| 492.8000 | 528.0000 | 563.2000 | 4 | 586.6667 | 625.7778 | 660.0000 |
| 513.3333 | 550.0000 | 586.6667 | 5 | 611.1111 | 651.8519 | 687.5000 |
| 547.5556 | 586.6667 | 625.7778 | 6 | 651.8519 | 695.3086 | 733.3333 |
| 574.9333 | 616.0000 | 657.0667 | 7 | 684.4444 | 730.0741 | 770.0000 |
| 616.0000 | 660.0000 | 704.0000 | 8 | 733.3333 | 782.2222 | 825.0000 |
| 657.0667 | 704.0000 | 750.9333 | 9 | 782.2222 | 834.3704 | 440.0000 |
| 684.4444 | 733.3333 | 782.2222 | 10 | 814.8148 | 869.1358 | 458.3333 |
| 730.0741 | 782.2222 | 834.3704 | 11 | 869.1358 | 463.5391 | 488.8889 |
| 770.0000 | 825.0000 | 440.0000 | 12 | 458.3333 | 488.8889 | 515.6250 |
| K7 R1 | K7 R2 | K7 R3 | I | K7 R4 | K7 R5 | K7 R6 |

TABLE II-continued

Array of tone identifiers for one octave based on reference pitch of 440 Hertz and scale (c) of Table I K = Key R = Chordal Root I = Tone Identifier

| | | | | | | |
|---|---|---|---|---|---|---|
| 616.0000 | 657.0667 | 693.0000 | 1 | 739.2000 | 770.0000 | 821.3333 |
| 657.0667 | 700.8711 | 739.2000 | 2 | 788.4800 | 821.3333 | 876.0889 |
| 693.0000 | 739.2000 | 779.6250 | 3 | 831.6000 | 866.2500 | 462.0000 |
| 739.2000 | 788.4800 | 831.6000 | 4 | 443.5200 | 462.0000 | 492.8000 |
| 770.0000 | 821.3333 | 866.2500 | 5 | 462.0000 | 481.2500 | 513.3333 |
| 821.3333 | 876.0889 | 462.0000 | 6 | 492.9000 | 513.3333 | 547.5556 |
| 862.4000 | 459.9467 | 485.1000 | 7 | 517.4400 | 539.0000 | 574.9333 |
| 462.0000 | 492.8000 | 519.7500 | 8 | 554.4000 | 577.5000 | 616.0000 |
| 492.8000 | 525.6533 | 554.4000 | 9 | 591.3600 | 616.0000 | 657.0667 |
| 513.3333 | 547.5556 | 577.5000 | 10 | 616.0000 | 641.6667 | 684.4444 |
| 547.5556 | 584.0593 | 616.0000 | 11 | 657.0667 | 684.4444 | 730.0741 |
| 577.5000 | 616.0000 | 649.6875 | 12 | 693.0000 | 721.8750 | 770.0000 |
| K7 R7 | K7 R8 | K7 R9 | I | K7 R10 | K7 R11 | K7 R12 |
| 862.4000 | 462.0000 | 492.8000 | 1 | 513.3333 | 547.5556 | 577.5000 |
| 459.9467 | 492.8000 | 525.6533 | 2 | 547.5556 | 584.0593 | 616.0000 |
| 485.1000 | 519.7500 | 554.4000 | 3 | 577.5000 | 616.0000 | 649.6875 |
| 517.4400 | 554.4000 | 591.3600 | 4 | 616.0000 | 657.0667 | 693.0000 |
| 539.0000 | 577.5000 | 616.0000 | 5 | 641.6667 | 684.4444 | 721.8750 |
| 574.9333 | 616.0000 | 657.0667 | 6 | 684.4444 | 730.0741 | 770.0000 |
| 603.6800 | 646.8000 | 689.9200 | 7 | 718.6667 | 766.5778 | 808.5000 |
| 646.8000 | 693.0000 | 739.2000 | 8 | 770.0000 | 821.3333 | 866.2500 |
| 689.9200 | 739.2000 | 788.4800 | 9 | 821.3333 | 876.0889 | 462.0000 |
| 718.6667 | 770.0000 | 821.3333 | 10 | 855.5556 | 456.2963 | 481.2500 |
| 766.5778 | 821.3333 | 876.0889 | 11 | 456.2963 | 486.7160 | 513.3333 |
| 808.5000 | 866.2500 | 462.0000 | 12 | 481.2500 | 513.3333 | 541.4063 |
| K8 R1 | K8 R2 | K8 R3 | I | K8 R4 | K8 R5 | K8 R6 |
| 660.0000 | 704.0000 | 742.5000 | 1 | 792.0000 | 825.0000 | 440.0000 |
| 704.0000 | 750.9333 | 792.0000 | 2 | 844.8000 | 440.0000 | 469.3333 |
| 742.5000 | 792.0000 | 835.3125 | 3 | 445.5000 | 464.0625 | 495.0000 |
| 792.0000 | 844.8000 | 445.5000 | 4 | 475.2000 | 495.0000 | 528.0000 |
| 825.0000 | 440.0000 | 464.0625 | 5 | 495.0000 | 515.6250 | 550.0000 |
| 440.0000 | 469.3333 | 495.0000 | 6 | 528.0000 | 550.0000 | 586.6667 |
| 462.0000 | 492.8000 | 519.7500 | 7 | 554.4000 | 577.5000 | 616.0000 |
| 495.0000 | 528.0000 | 556.8750 | 8 | 594.0000 | 618.7500 | 660.0000 |
| 528.0000 | 563.2000 | 594.0000 | 9 | 633.6000 | 660.0000 | 704.0000 |
| 550.0000 | 586.6667 | 618.7500 | 10 | 660.0000 | 687.5000 | 733.3333 |
| 586.6667 | 625.7778 | 660.0000 | 11 | 704.0000 | 733.3333 | 782.2222 |
| 618.7500 | 660.0000 | 696.0938 | 12 | 742.5000 | 773.4375 | 825.0000 |
| K8 R7 | K8 R8 | K8 R9 | I | K8 R10 | K8 R11 | K8 R12 |
| 462.0000 | 495.0000 | 528.0000 | 1 | 550.0000 | 586.6667 | 618.7500 |
| 492.8000 | 528.0000 | 563.2000 | 2 | 586.6667 | 625.7778 | 660.0000 |
| 519.7500 | 556.8750 | 594.0000 | 3 | 618.7500 | 660.0000 | 696.0938 |
| 554.4000 | 594.0000 | 633.6000 | 4 | 660.0000 | 704.0000 | 742.5000 |
| 577.5000 | 618.7500 | 660.0000 | 5 | 687.5000 | 733.3333 | 773.4375 |
| 616.0000 | 660.0000 | 704.0000 | 6 | 733.3333 | 782.2222 | 825.0000 |
| 646.8000 | 693.0000 | 739.2000 | 7 | 770.0000 | 821.3333 | 866.2500 |
| 693.0000 | 742.5000 | 792.0000 | 8 | 825.0000 | 440.0000 | 464.0625 |
| 739.2000 | 792.0000 | 844.8000 | 9 | 440.0000 | 469.3333 | 495.0000 |
| 770.0000 | 825.0000 | 440.0000 | 10 | 458.3333 | 488.8889 | 515.6250 |
| 821.3333 | 440.0000 | 469.3333 | 11 | 488.8889 | 521.4815 | 550.0000 |
| 866.2500 | 464.0625 | 495.0000 | 12 | 515.6250 | 550.0000 | 580.0781 |
| K9 R1 | K9 R2 | K9 R3 | I | K9 R4 | K9 R5 | K9 R6 |
| 704.0000 | 750.9333 | 792.0000 | 1 | 844.8000 | 440.0000 | 469.3333 |
| 750.9333 | 800.9956 | 844.8000 | 2 | 450.5600 | 469.3333 | 500.6222 |
| 792.0000 | 844.8000 | 445.5000 | 3 | 475.2000 | 495.0000 | 528.0000 |
| 844.8000 | 450.5600 | 475.2000 | 4 | 506.8800 | 528.0000 | 563.2000 |
| 440.0000 | 469.3333 | 495.0000 | 5 | 528.0000 | 550.0000 | 586.6667 |
| 469.3333 | 500.6222 | 528.0000 | 6 | 563.2000 | 586.6667 | 625.7778 |
| 492.8000 | 525.6533 | 554.4000 | 7 | 591.3600 | 616.0000 | 657.0667 |
| 528.0000 | 563.2000 | 594.0000 | 8 | 633.6000 | 660.0000 | 704.0000 |
| 563.2000 | 600.7467 | 633.6000 | 9 | 675.8400 | 704.0000 | 750.9333 |
| 586.6667 | 625.7778 | 660.0000 | 10 | 704.0000 | 733.3333 | 782.2222 |
| 625.7778 | 667.4963 | 704.0000 | 11 | 750.9333 | 782.2222 | 834.3704 |
| 660.0000 | 704.0000 | 742.5000 | 12 | 792.0000 | 825.0000 | 440.0000 |

TABLE II-continued

Array of tone identifiers for one octave
based on reference pitch of 440 Hertz and scale (c) of Table I K = Key R = Chordal Root I = Tone Identifier

| K9 R7 | K9 R8 | K9 R9 | I | K9 R10 | K9 R11 | K9 R12 |
|---|---|---|---|---|---|---|
| 492.8000 | 528.0000 | 563.2000 | 1 | 586.6667 | 625.7778 | 660.0000 |
| 525.6533 | 563.2000 | 600.7467 | 2 | 625.7778 | 667.4963 | 704.0000 |
| 554.4000 | 594.0000 | 633.6000 | 3 | 660.0000 | 704.0000 | 742.5000 |
| 591.3600 | 633.6000 | 675.8400 | 4 | 704.0000 | 750.9333 | 792.0000 |
| 616.0000 | 660.0000 | 704.0000 | 5 | 733.3333 | 782.2222 | 825.0000 |
| 657.0667 | 704.0000 | 750.9333 | 6 | 782.2222 | 834.3704 | 440.0000 |
| 689.9200 | 739.2000 | 788.4800 | 7 | 821.3333 | 876.0889 | 462.0000 |
| 739.2000 | 792.0000 | 844.8000 | 8 | 440.0000 | 469.3333 | 495.0000 |
| 788.4800 | 844.8000 | 450.5600 | 9 | 469.3333 | 500.6222 | 528.0000 |
| 821.3333 | 440.0000 | 469.3333 | 10 | 488.8889 | 521.4815 | 550.0000 |
| 876.0889 | 469.3333 | 500.6222 | 11 | 521.4815 | 556.2469 | 586.6667 |
| 462.0000 | 495.0000 | 528.0000 | 12 | 550.0000 | 586.6667 | 618.7500 |
| K10 R1 | K10 R2 | K10 R3 | I | K10 R4 | K10 R5 | K10 R6 |
| 733.3333 | 782.2222 | 825.0000 | 1 | 440.0000 | 458.3333 | 488.8889 |
| 782.2222 | 834.3704 | 440.0000 | 2 | 469.3333 | 488.8889 | 521.4815 |
| 825.0000 | 440.0000 | 464.0625 | 3 | 495.0000 | 515.6250 | 550.0000 |
| 440.0000 | 469.3333 | 495.0000 | 4 | 528.0000 | 550.0000 | 586.6667 |
| 458.3333 | 488.8889 | 515.6250 | 5 | 550.0000 | 572.9167 | 611.1111 |
| 488.8889 | 521.4815 | 550.0000 | 6 | 586.6667 | 611.1111 | 651.8519 |
| 513.3333 | 547.5556 | 577.5000 | 7 | 616.0000 | 641.6667 | 684.4444 |
| 550.0000 | 586.6667 | 618.7500 | 8 | 660.0000 | 687.5000 | 733.3333 |
| 586.6667 | 625.7778 | 660.0000 | 9 | 704.0000 | 733.3333 | 782.2222 |
| 611.1111 | 651.8519 | 687.5000 | 10 | 733.3333 | 763.8889 | 814.8148 |
| 651.8519 | 695.3086 | 733.3333 | 11 | 782.2222 | 814.8148 | 869.1358 |
| 687.5000 | 733.3333 | 773.4375 | 12 | 825.0000 | 859.3750 | 458.3333 |
| K10 R7 | K10 R8 | K10 R9 | I | K10 R10 | K10 R11 | K10 R12 |
| 513.3333 | 550.0000 | 586.6667 | 1 | 611.1111 | 651.8519 | 687.5000 |
| 547.5556 | 586.6667 | 625.7778 | 2 | 651.8519 | 695.3086 | 733.3333 |
| 577.5000 | 618.7500 | 660.0000 | 3 | 687.5000 | 733.3333 | 773.4375 |
| 616.0000 | 660.0000 | 704.0000 | 4 | 733.3333 | 782.2222 | 825.0000 |
| 641.6667 | 687.5000 | 733.3333 | 5 | 763.8889 | 814.8148 | 859.3750 |
| 684.4444 | 733.3333 | 782.2222 | 6 | 814.8148 | 869.1358 | 458.3333 |
| 718.6667 | 770.0000 | 821.3333 | 7 | 855.5556 | 456.2963 | 481.2500 |
| 770.0000 | 825.0000 | 440.0000 | 8 | 458.3333 | 488.8889 | 515.6250 |
| 821.3333 | 440.0000 | 469.3333 | 9 | 488.8889 | 521.4815 | 550.0000 |
| 855.5556 | 458.3333 | 488.8889 | 10 | 509.2593 | 543.2099 | 572.9167 |
| 456.2963 | 488.8889 | 521.4815 | 11 | 543.2099 | 579.4239 | 611.1111 |
| 481.2500 | 515.6250 | 550.0000 | 12 | 572.9167 | 611.1111 | 644.5313 |
| K11 R1 | K11 R2 | K11 R3 | I | K11 R4 | K11 R5 | K11 R6 |
| 782.2222 | 834.3704 | 440.0000 | 1 | 469.3333 | 488.8889 | 521.4815 |
| 834.3704 | 444.9975 | 469.3333 | 2 | 500.6222 | 521.4815 | 556.2469 |
| 440.0000 | 469.3333 | 495.0000 | 3 | 528.0000 | 550.0000 | 586.6667 |
| 469.3333 | 500.6222 | 528.0000 | 4 | 563.2000 | 586.6667 | 625.7778 |
| 488.8889 | 521.4815 | 550.0000 | 5 | 586.6667 | 611.1111 | 651.8519 |
| 521.4815 | 556.2469 | 586.6667 | 6 | 625.7778 | 651.8519 | 695.3086 |
| 547.5556 | 584.0593 | 616.0000 | 7 | 657.0667 | 684.4444 | 730.0741 |
| 586.6667 | 625.7778 | 660.0000 | 8 | 704.0000 | 733.3333 | 782.2222 |
| 625.7778 | 667.4963 | 704.0000 | 9 | 750.9333 | 782.2222 | 834.3704 |
| 651.8519 | 695.3086 | 733.3333 | 10 | 782.2222 | 814.8148 | 869.1358 |
| 695.3086 | 741.6626 | 782.2222 | 11 | 834.3704 | 869.1358 | 463.5391 |
| 733.3333 | 782.2222 | 825.0000 | 12 | 880.0000 | 458.3333 | 488.8889 |
| K11 R7 | K11 R8 | K11 R9 | I | K11 R10 | K11 R11 | K11 R12 |
| 547.5556 | 586.6667 | 625.7778 | 1 | 651.8519 | 695.3086 | 733.3333 |
| 584.0593 | 625.7778 | 667.4963 | 2 | 695.3086 | 741.6626 | 782.2222 |
| 616.0000 | 660.0000 | 704.0000 | 3 | 733.3333 | 782.2222 | 825.0000 |
| 657.0667 | 704.0000 | 750.9333 | 4 | 782.2222 | 834.3704 | 880.0000 |
| 684.4444 | 733.3333 | 782.2222 | 5 | 814.8148 | 869.1358 | 458.3333 |
| 730.0741 | 782.2222 | 834.3704 | 6 | 869.1358 | 463.5391 | 488.8889 |
| 766.5778 | 821.3333 | 876.0889 | 7 | 456.2963 | 486.7160 | 513.3333 |
| 821.3333 | 440.0000 | 469.3333 | 8 | 488.8889 | 521.4815 | 550.0000 |
| 876.0889 | 469.3333 | 500.6222 | 9 | 521.4815 | 556.2469 | 586.6667 |
| 456.2963 | 488.8889 | 521.4815 | 10 | 543.2099 | 579.4239 | 611.1111 |
| 486.7160 | 521.4815 | 556.2469 | 11 | 579.4239 | 618.0521 | 651.8519 |
| 513.3333 | 550.0000 | 586.6667 | 12 | 611.1111 | 651.8519 | 687.5000 |

TABLE II-continued

Array of tone identifiers for one octave based on reference pitch of 440 Hertz and scale (c) of Table I K = Key R = Chordal Root I = Tone Identifier

| K12 R1 | K12 R2 | K12 R3 | I | K12 R4 | K12 R5 | K12 R6 |
|---|---|---|---|---|---|---|
| 825.0000 | 440.0000 | 464.0625 | 1 | 495.0000 | 515.6250 | 550.0000 |
| 440.0000 | 469.3333 | 495.0000 | 2 | 528.0000 | 550.0000 | 586.6667 |
| 464.0625 | 495.0000 | 522.0703 | 3 | 556.8750 | 580.0781 | 618.7500 |
| 495.0000 | 528.0000 | 556.8750 | 4 | 594.0000 | 618.7500 | 660.0000 |
| 515.6250 | 550.0000 | 580.0781 | 5 | 616.7500 | 644.5313 | 687.5000 |
| 550.0000 | 586.6667 | 618.7500 | 6 | 660.0000 | 687.5000 | 733.3333 |
| 577.5000 | 616.0000 | 649.6875 | 7 | 693.0000 | 721.8750 | 770.0000 |
| 618.7500 | 660.0000 | 696.0938 | 8 | 742.5000 | 773.4375 | 825.0000 |
| 660.0000 | 704.0000 | 742.5000 | 9 | 792.0000 | 825.0000 | 440.0000 |
| 687.5000 | 733.3333 | 773.4375 | 10 | 825.0000 | 859.3750 | 458.3333 |
| 733.3333 | 782.2222 | 825.0000 | 11 | 880.0000 | 458.3333 | 488.8889 |
| 773.4375 | 825.0000 | 870.1172 | 12 | 464.0625 | 483.3984 | 515.6250 |
| **K12 R7** | **K12 R8** | **K12 R9** | **I** | **K12 R10** | **K12 R11** | **K12 R12** |
| 577.5000 | 618.7500 | 660.0000 | 1 | 687.5000 | 733.3333 | 773.4375 |
| 616.0000 | 660.0000 | 704.0000 | 2 | 733.3333 | 782.2222 | 825.0000 |
| 649.6875 | 696.0938 | 742.5000 | 3 | 773.4375 | 825.0000 | 870.1172 |
| 693.0000 | 742.5000 | 792.0000 | 4 | 825.0000 | 880.0000 | 464.0625 |
| 721.8750 | 773.4375 | 825.0000 | 5 | 859.3750 | 458.3333 | 483.3984 |
| 770.0000 | 825.0000 | 440.0000 | 6 | 458.3333 | 488.8889 | 515.6250 |
| 808.5000 | 866.2500 | 462.0000 | 7 | 481.2500 | 513.3333 | 541.4063 |
| 866.2500 | 464.0625 | 495.0000 | 8 | 515.6250 | 550.0000 | 580.0781 |
| 462.0000 | 495.0000 | 528.0000 | 9 | 550.0000 | 586.6667 | 618.7500 |
| 481.2500 | 515.6250 | 550.0000 | 10 | 572.9167 | 611.1111 | 644.5313 |
| 513.3333 | 550.0000 | 586.6667 | 11 | 611.1111 | 651.8519 | 687.5000 |
| 541.4063 | 580.0781 | 618.7500 | 12 | 644.5313 | 687.5000 | 725.0977 |

The 12 key tones of the array in Hertz are: 440, 469.3333, 495, 528, 550, 586.6667, 616, 660, 704, 733.3333, 782.2222, 825. The second and third chordal roots of the key tone 469.3333 (key 2) are 500.6222 and 528 respectively. The first and second tone identifiers for the third root of the second key tone are 528 and 563.2 respectively.

In playing a musical composition, the musician may want to play, for example, in the key of A in a chromatic scale of just intonation. The musician either relies on the default selections of reference pitch and scale or inputs them using the keypad 26 and the pitch selection button 30 or the scale selection button 28 respectively. The LCD displays 32, 33 of the selector unit 20 display the scale and pitch which have been selected.

The musician having selected the parameters of reference pitch and scale, the CPU 48 then calculates and stores into RAM 52 the three dimensional array of key tones, chordal roots and tone identifiers for the complete just intonation scale which was selected.

Before beginning to play, the musician presses one of the 12 key selectors 22. By pressing the key selector, the musician informs the CPU 48 of the key in which the composition will be started. The musician then presses one of the 12 root selector keys 24 to define the chordal root in which the composition will be started. The LCD displays 32, 33 of the selector unit display the numbers of the key and chordal root which have been selected. Alternatively the key surfaces of key selector 22 and root selector 24 may be constructed to remain depressed, thereby indicating the current key and the current root, until another key is pressed to make a new selection. Anytime the key and/or chordal root are so selected, the CPU 48 looks up in RAM 52 the n tone identifiers corresponding to the selected musical key and chordal root. The CPU 48 then retrieves the set of n tone identifiers from RAM 52, converts them to MIDI data format for each octave, builds a MIDI system exclusive message in accordance with MIDI specifications and sends it to the tone generator 42. The tone generator is thus retuned so that when an interval is played by the musician, the tone generator 42 will sound the tone corresponding to the selected just intonation key and chordal root.

The musician plays the composition by pressing the instrument keys 12 of the keyboard 10 in the usual manner. Each time an instrument key is played, the interval corresponding to that instrument key is communicated through the selector unit 20 directly to the tone generator 42, which then sounds the tone corresponding to the interval as tuned by the tone identifiers from the array 54.

As the musician plays a composition, it will most likely be necessary to play various chords, the tones of which would not in the prior art be in just intonation with each other. However, using the invention, the musician simply selects a different chordal root by pressing one of the 12 root selectors 24. As a result the CPU 48 retrieves from the array 54 in RAM 52 the set of n tone identifiers corresponding to the previously selected musical key and the newly selected chordal root and sends them as a retuning instruction for each octave to the tone generator 42. Thus, anytime a new chordal root is selected, each of the tones represented by the tone identifiers will be in just intonation with respect to each other.

If the musician wishes to change musical key, one of the key selectors 22 is pressed to identify the new key and a root selector 24 to select a new root. As a result the CPU 48 retrieves from the array 54 the set of n tone identifiers for the newly selected key and root and sends them to the tone generator 42. Of course, in view of the manner in which the array has been derived, the tones represented by the tone identifiers for each root are in just intonation with one another so that changing key and root maintains just intonation.

The structure of the array allows a chord to be built from any root tone. When, however, the musician or composer chooses to switch chordal roots, for example to play a supertonic minor chord (based on the Second, 9:8 from the key, that is, a B-minor (Bm) chord in the key of A), then a new tuning of the scale for that root must be chosen in order to keep all notes or intervals in the chord consonant with the new root. In the example above, a Bm chord in the key of A includes a flatted Third note which in this case is a D note. According to the invention, this D is not the same frequency as a D note played as the Fourth (4:3) of A. The D that is a flatted Third of B is (in the array based on scale (c) of Table I) 6:5 of Root B, which is 9:8 of Key A, which equals 27:20, not 4:3 (different by an interval of 81:80). This microtuning is accomplished by selecting the B Root which selects a single scale, i.e. a set of n tones from the $n^2$matrix (which has been selected from the $n^3$ array by key selection) corresponding to the instrument keys of the keyboard. In this example, when the musician selects the D note by playing the D instrument key on the keyboard, the key, root, and interval data combine to select the appropriate D (27:20) that is consonant with the chordal root B. In Table II this D note corresponds to K1, R3, I4, that is, 594 Hz, which differs by 7.3333 Hz from the D at K1, R1, I6, which is 586.666 Hz. The musician has already selected a key, and merely selects a root while playing.

It will be understood that although the key and chordal root selection means of the preferred embodiment are in the form of piano-type keys, the selection means may be foot pedal switches, toggle switches, keys on a standard computer keyboard, or any other means suitable to a particular embodiment of the invention. Similarly, the preferred embodiment provides a set of n selection switches for the selection of keys and a set of n selection switches for the selection of roots, but alternatively, a set of n selection switches may be combined with a single switch to select between key and root selection mode. Moreover, it will be appreciated that the invention can be applied to any type of instrument which is capable of being tuned in real time, each note being tunable to each of the required and distinct tones from the full set of $n^2$ tones.

In addition, various arrangements of selector unit and instruments may be used without departing from the principles of the invention. For example, the selector unit may be incorporated into the electronic keyboard or other instrument to which the invention is applied. Key and root selection switches may be incorporated into the keyboard of a key-type instrument and may be combined with pedal switches.

The CPU can be physically located either in the instrument, in the sounding means, or even in a separate housing. It is also within the scope of this invention to deliver only one tone identifier at a time to the tone generator or other sounding means, as each interval is played by a musician, rather than downloading a set of n tone identifiers to the tone generator each time a new key or chordal root is selected. In such case, the CPU includes a buffer for holding the n tone identifiers corresponding to the key and chordal root. Rather than accessing the array itself, the CPU need only access the buffer to retrieve a tone identifier corresponding to a single interval, and transmit it to the tone generator.

As an alternative embodiment, the invention may be created with a general purpose computer controlled by specialized software. The computer memory will serve the function of the RAM for storing the array of tone identifiers. Re-writable persistent memory, such as a hard disk, would be used rather than the ROM. Any desired keys of the keyboard can be designated for key input, root input, reference frequency input, and preferred scale input. A portion of the screen can indicate how the keys are used to provide such input and another portion of the screen can indicate the selected key and root. To connect the computer with a keyboard, a MIDI may be used. Alternatively, the computer may be used to play compositions created at the computer keyboard, not in real time. The output from the computer can be via a MIDI interface to a tone generator or, with chips that generate sound frequencies, the hardware in the computer can directly generate the tones.

As another alternative, the invention can be constructed without a processor (CPU) and software. Instead, an array of logic gates can be structured with inputs for each of the possible scale selections, pitch selections, key selections, root selections, and each key of the keyboard. The output from this logic array can be MIDI specifications or activation of tone generator circuits to directly generate the desired tones. The complexity of the logic array can be reduced by reducing the choices presented to the user, such as allowing only one scale or only one reference pitch or only a limited number of keys or a limited number of roots within each key.

Figure 2:
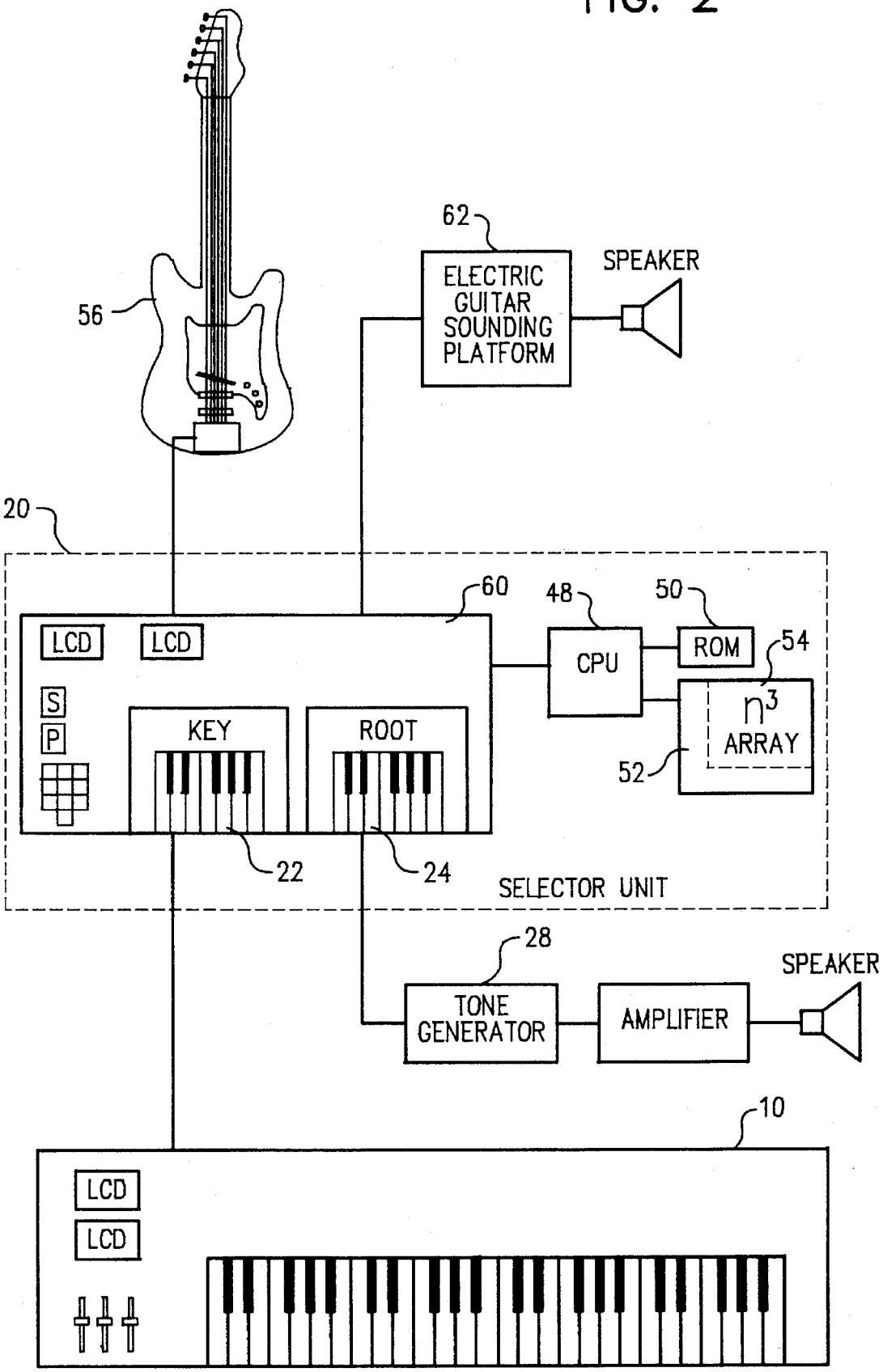
FIG. 2 illustrates an alternative embodiment of the invention for simultaneously controlling tuning in just intonation of several musical instruments.
Figure 3:
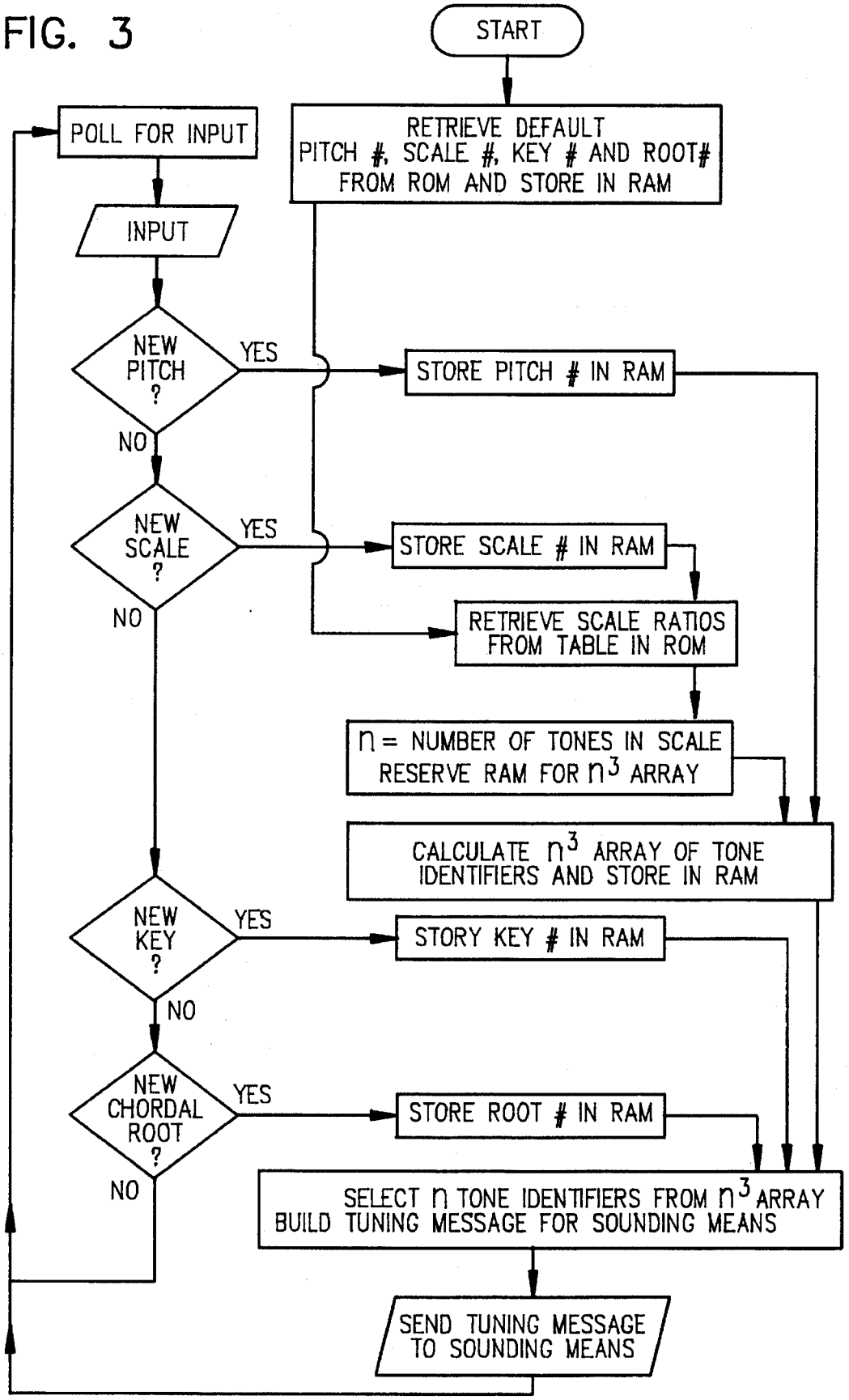
FIG. 3 is a flowchart of the software used in the preferred embodiment of the invention.

In another embodiment of the invention, illustrated in FIG. 2, several instruments are controlled in just intonation by a single musician who signals a change of chordal root or modulation of key for all instruments. In FIG. 2 the instruments are a MIDI guitar controller 56 and a keyboard 10. A guitar with steel strings can be used by a musician for a note selection means by placing an electronic pickup near the strings and converting the electronic representations of string vibrations into MIDI signals. Such a device is sold by Roland Corporation as a GR-09 Guitar Synthesizer. Each musician whose instrument is connected to the system will thereby only have to select the desired note or notes as with any conventional instrument, and the resulting chords will be in just intonation. This is achieved by providing a selector unit 20 having a CPU 48 with a ROM chip 50 and RAM 52 as discussed above, and key and chordal root selection keys 22 and 24 respectively. The selection console 60 is networked through MIDI interface and ports with the instruments. The n tone identifiers are retrieved by the CPU as described above and are communicated to each tone generator or other sounding means associated with each instrument in the network by means of a message in MIDI System Exclusive format, and these sounding means are thereby tuned, in all octaves, to the scale of n tones selected by the selector unit 20. The players of the individual instruments select the notes to be played, and the corresponding just intonation tones are sounded.

In another embodiment of the invention, the key and root selector unit is attached to a computer MIDI or parallel or serial port so that the tuning data intended for the tone generator can be retrieved by software and stored in any manner suitable for the software to add the tuning data at the appropriate location to an existing musical data file or sequence of musical data for transmission as retuning instructions to the tone generator as previously described so that the music in the musical data file or musical sequence will be played in just intonation. This embodiment may be used to generate musical recordings or output from musical data sequence recordings which were originally created with unspecified tuning or equal tempered tuning (or any tuning) by adding to the musical data sequence recording selections of key and chordal root, allowing the recording to be played in just intonation.

In another embodiment of the invention, software is used to store the selections of key and root in a data file along with a time code which is part of, or synchronized to, a musical data file or sequence. When the musical file or sequence is played, the key and root selections are sent to the CPU which retrieves from the array in RAM the set of n tone identifiers and sends them as retuning instructions to the tone generator as previously described so that the music in the musical data file or musical sequence will be played in just intonation. When the selections of key and root stored in such a data file along with a time code are played, it relieves the musician of the need to adjust the key and chordal root while he is playing. Such a data file may be reproduced and distributed in the form of a recording or electronically transmitted data file for use by many musicians.

It will be appreciated by those skilled in the art that the above description of the preferred embodiment and of the alternative and other embodiments of the invention are illustrative and are not to be understood as limiting the scope of the invention.

We claim:

1. A method for automatically adjusting the tuning of a musical device, having a note selection receiver and pitch production means, to produce a plurality of pitches with just intervals when note selections are provided to the note selection receiver, comprising:

receiving via a first apparatus a selected key and a first selected chordal root within the key; automatically determining the pitches to be produced when note selections are received based on a just interval from the tonic of the selected key to the tonic of the selected chordal root and just intervals from the tonic of the first selected chordal root to each of the selected notes; and, via a second apparatus, communicating the determined pitches to the musical device.

2. The method of claim 1 further comprising:

receiving via the first apparatus a second selected chordal root within the selected key; and automatically determining the pitches to be produced when note selections are received based on a just interval from the tonic of the selected key to the tonic of the second selected chordal root and just intervals from the tonic of the second selected chordal root to each of the selected notes.

3. Apparatus for processing data sequences comprised of musical note specifications to add key and chordal root selections thereby producing musical data which may be played in just intonation, comprising:

means for receiving via a first input a selected key and a first selected chordal root within the key;

means for receiving via a second input the data sequences comprised of musical note specifications;

means for automatically combining the key and chordal root specifications with the data sequences and outputting the combination.

4. The apparatus of claim 3 further comprising:

means for receiving via the first input a second selected chordal root within the key while receiving via the second input the data sequences comprised of musical note specifications.

5. Apparatus for adjusting the tuning of a musical device, having note selection receivers and a pitch provider, to provide a plurality of pitches with just intervals when note selections are provided to the note selection receivers, comprising:

selection receiving means for receiving a selected key and chordal root within the key;

means for determining the pitches to be provided when note selections are received based on a just interval from the tonic of the selected key to the tonic of the selected chordal root and just intervals from the tonic of the selected chordal root to each of the selected notes; and means for communicating the determined pitches to the musical device.

6. The apparatus of claim 5 wherein the means for determining the just intonation tone to be provided comprises an electrical circuit having an input for receiving the selected key and the selected chordal root within the key and having an output which provides the pitches.

7. The apparatus of claim 6 wherein the electrical circuit comprises:

a memory containing tone identifiers, at least one of which tone identifiers specifies a just intonation interval between itself and at least one other tone identifier in the memory and a logic circuit which selects a tone identifier in the memory based on the selected key, the selected chordal root, and the selected note.

8. The apparatus of claim 7 in which the logic circuit comprises a microprocessor and a computer program which causes the microprocessor to select a tone identifier in the memory based on the selected key, the selected chordal root, and the selected note.

9. The apparatus of claim 6 wherein the input for receiving the selected key and the selected chordal root within the key further comprises:

a coupling to a reader of an electronic data file containing specifications of a selected key and a first selected chordal root within the key.

10. The apparatus of claim 9 in which the electronic data file further contains specification of a second selected chordal root within the key.

11. Apparatus for adjusting the tuning of a musical instrument to play in just intonation while the instrument is being played, comprising:

sounding means associated with the musical instrument for producing musical tones;

a memory for storing $n^3$ tone identifiers, where n is the number of tones in one octave of a scale, the tone identifiers being grouped in sets of n tone identifiers for each of n chordal roots for each of n musical keys, and wherein each tone identifier corresponds to a tone to be generated by the sounding means of the instrument and wherein the set of tones corresponding to the tone identifiers produce just intonation intervals;

selection means associated with the musical instrument for enabling a musician to select a key and a chordal root within the key in which tones of a composition are to be played;

a logic circuit associated with the musical instrument;

means associated with the logic circuit for retrieving from the memory at least one tone identifier from the set of n tone identifiers corresponding to the key and the chordal root selected by said selection means and communicating to the sounding means said at least one of such retrieved tone identifiers.

12. Apparatus as in claim 11 wherein the set of tone identifiers is comprised of musical key tones defined by a set of n ratios applied to a single pitch, $n^2$ chordal root tones defined by the said set of n ratios applied to each of said n key tones, and $n^3$ tone identifiers defined by said set of n ratios applied to each of said $n^2$ root tones.

13. Apparatus as in claim 12 further comprising scale selection means for receiving a selected set of n ratios.

14. A method of adjusting the tuning of a musical instrument to play in just intonation while the instrument is being played wherein selection means are associated with the musical instrument for enabling a musician to select a key and a chordal root, and memory means are associated with the musical instrument for storing a data base comprising sets of n tone identifiers for each of n chordal roots for each of n musical keys; and sounding means are associated with the musical instrument for producing musical tones, comprising:

selecting a key and a chordal root within a musical key;

communicating said selected key and chordal root to the said data base;

retrieving from said data base at least one tone identifier selected from the set of n tone identifiers corresponding to the selected key and chordal root;

communicating said at least one tone identifier to said sounding means of said musical instrument whereby to cause the sounding means to produce said at least one tone when said tone is selected to be played by the musician.

* * * * *